US005203728A

United States Patent [19]

Kobayashi

[11] Patent Number: 5,203,728

[45] Date of Patent: Apr. 20, 1993

[54] WATERCRAFT WITH A COUPLE OF WATER JET PROPULSION UNITS

[75] Inventor: Noboru Kobayashi, Iwata, Japan

[73] Assignee: Yamaha Hatsudoki Kabushiki Kaisha, Iwata, Japan

[21] Appl. No.: 544,404

[22] Filed: Jun. 27, 1990

[30] Foreign Application Priority Data

Jul. 11, 1989 [JP] Japan ..... 1-180047

[51] Int. Cl.[5] ..... B63H 16/08

[52] U.S. Cl. ..... 440/38; 440/69

[58] Field of Search ..... 440/38, 40, 41, 42, 440/43, 46, 47, 69; 114/289, 290; 60/221, 222

[56] References Cited

U.S. PATENT DOCUMENTS 3,207,116 9/1965 FRX ..... 440/41

4,044,705 8/1977 Roberts ..... 440/61

4,459,117 7/1984 Jordan ..... 440/38

FOREIGN PATENT DOCUMENTS 25272 6/1976 Japan ..... 440/38

405634 1/1934 United Kingdom ..... 440/42

951661 3/1964 United Kingdom ..... 440/38

*Primary Examiner*—Jesus D. Sotelo

*Attorney, Agent, or Firm*—Ernest A. Beutler

[57] ABSTRACT

Several embodiments of watercraft hulls propelled by dual jet propulsion units. The jet propulsion units are either received within a common tunnel or a pair of separate tunnels of the watercraft hull and are moveable for servicing and to bring the jet propulsion units out of the water when the watercraft is not being operated but still is in the body of water.

31 Claims, 7 Drawing Sheets

WATERCRAFT WITH A COUPLE OF WATER JET PROPULSION UNITS

BACKGROUND OF THE INVENTION

This invention relates to a watercraft and more particularly to an improved watercraft powered by a pair of jet propulsion units.

It is well known that jet propulsion units have a number of advantages for use in watercraft, particularly for certain types of applications and environments. However, like conventional propeller units, there is a practical limit to the size which a jet propulsion can be constructed. Said another way, there are certain advantages in providing pairs of propulsion units rather than a single large propulsion unit. However, watercraft of the type previously proposed have not lent themselves to propulsion by a pair of jet propulsion units.

It is, therefore, a principal object of this invention to provide an improved watercraft construction that permits propulsion by a plurality of jet propulsion units.

It is a further object of this invention to provide a watercraft propelled by a plurality of jet propulsion units.

SUMMARY OF THE INVENTION

This invention is adapted to be embodied in a watercraft having a hull and a pair of jet propulsion units each mounted in the hull in generally parallel relationship to each other. Each of the jet propulsion units has an inlet for receiving water from a body of water in which the watercraft is operating, an impeller section and a discharge nozzle for discharging water from the jet propulsion unit for propelling the hull.

DETAILED DESCRIPTION OF THE PREFERRED EMBODIMENTS OF THE INVENTION

Figure 1:
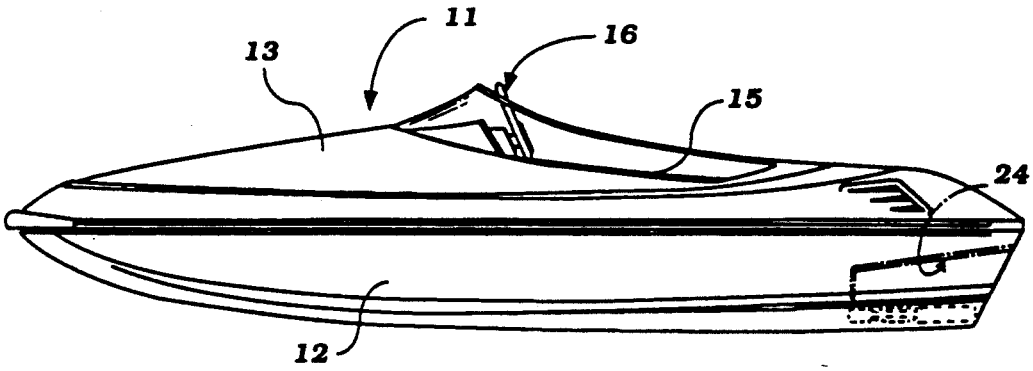
FIG. 1 is a side elevational view of a watercraft constructed in accordance with an embodiment of the invention.
Figure 2:
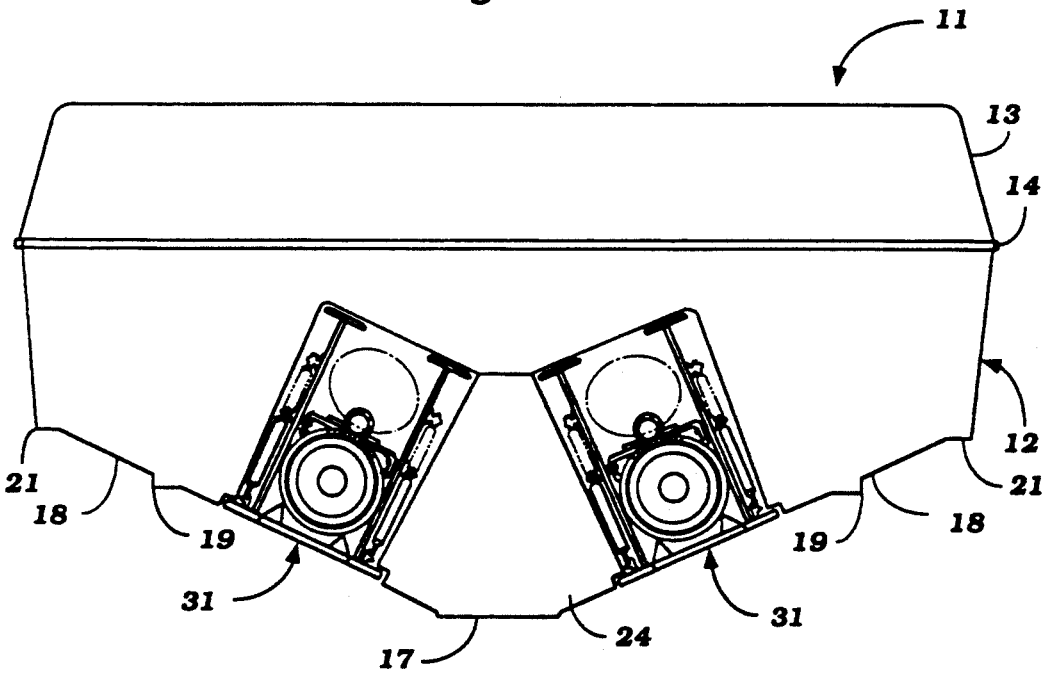
FIG. 2 is an enlarged rear elevational view of the watercraft.

Referring first to the embodiment of FIGS. 1 through 7, and initially to FIGS. 1 through 5, a jet propelled watercraft constructed in accordance with a first embodiment of the invention is identified generally by the reference numeral 11.

The watercraft 11 is comprised of a hull which may be formed from molded fiberglass reinforced resin or the like and which is comprised of a lower hull portion 12 and a deck 13. The hull 12 and deck 13 are conveniently affixed to each other in a suitable manner, as by means of an interlocking flange 14 formed around the periphery thereof. There is provided to the rear of the watercraft 11 a rider's area indicated generally at 15 in FIG. 1 which has a steering wheel 16 and other appropriate controls located on the dash thereof.

The hull 12 has generally a V configuration with a generally flat central portion 17 from which a pair of inclined side portions 18 extend. The side portions 18 are provided with one or more chines 19 so as to assist in stability. In addition, a chine or ledge 21 is formed at the outer periphery of the portions 18 where they join the upstanding sides of the hull. The deck portion 13 has a downwardly depressed area 22 which defines in part the rider's are 15 and which terminates at its lower end in a floor board 23.

In accordance with the invention, the watercraft 11 is propelled by a pair of jet propulsion units that are mounted in a tunnel 24 formed at the rear portion of the hull. The tunnel 24 is formed by a pair of upstanding side walls 25 that extend generally perpendicularly to the inclined hull portions 18 and an upper area 26 that has a configuration which is generally parallel to the lower portion of the hull. The tunnel 24, accordingly, provides an area that extends upwardly into the rider's area as may be readily apparent from the drawings and particularly FIG. 3.

A pair of jet propulsion units, each indicated generally by the reference numeral 27 is mounted in side by side in a parallel extending relationship within the tunnel 24. The jet propulsion units 27 are mounted outwardly adjacent the side walls 25 and have a configuration and operation as generally described in my copending application entitled "Water Jet Propulsion Unit", Ser. No. 489,361, filed Mar. 6, 1990 and assigned to the Assignee hereof. Specifically, each of the jet propulsion units 27 has a construction and operation as described and illustrated in the embodiment of FIGS. 1 through 4 thereof. Reference may be had to that copending application, the disclosure of which is hereby incorporated by reference, for the details of the construction.

Figure 6:
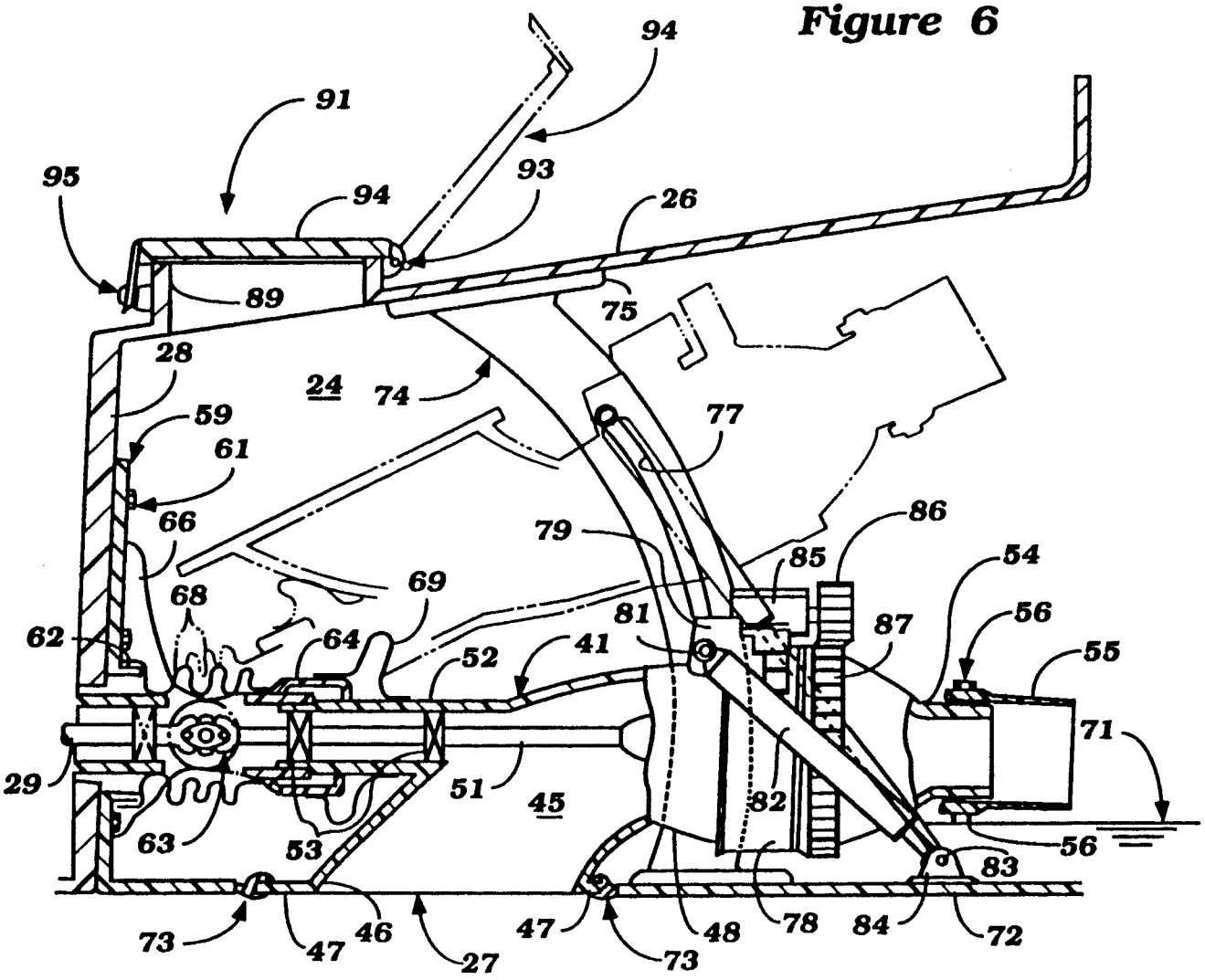
FIG. 6 is an enlarged cross sectional view taken through one of the jet propulsion units showing the unit in its normal position in solid lines and in its service or non propulsion position as shown in phantom lines and having portions of the jet propulsion unit broken away and shown in section.
Figure 7:
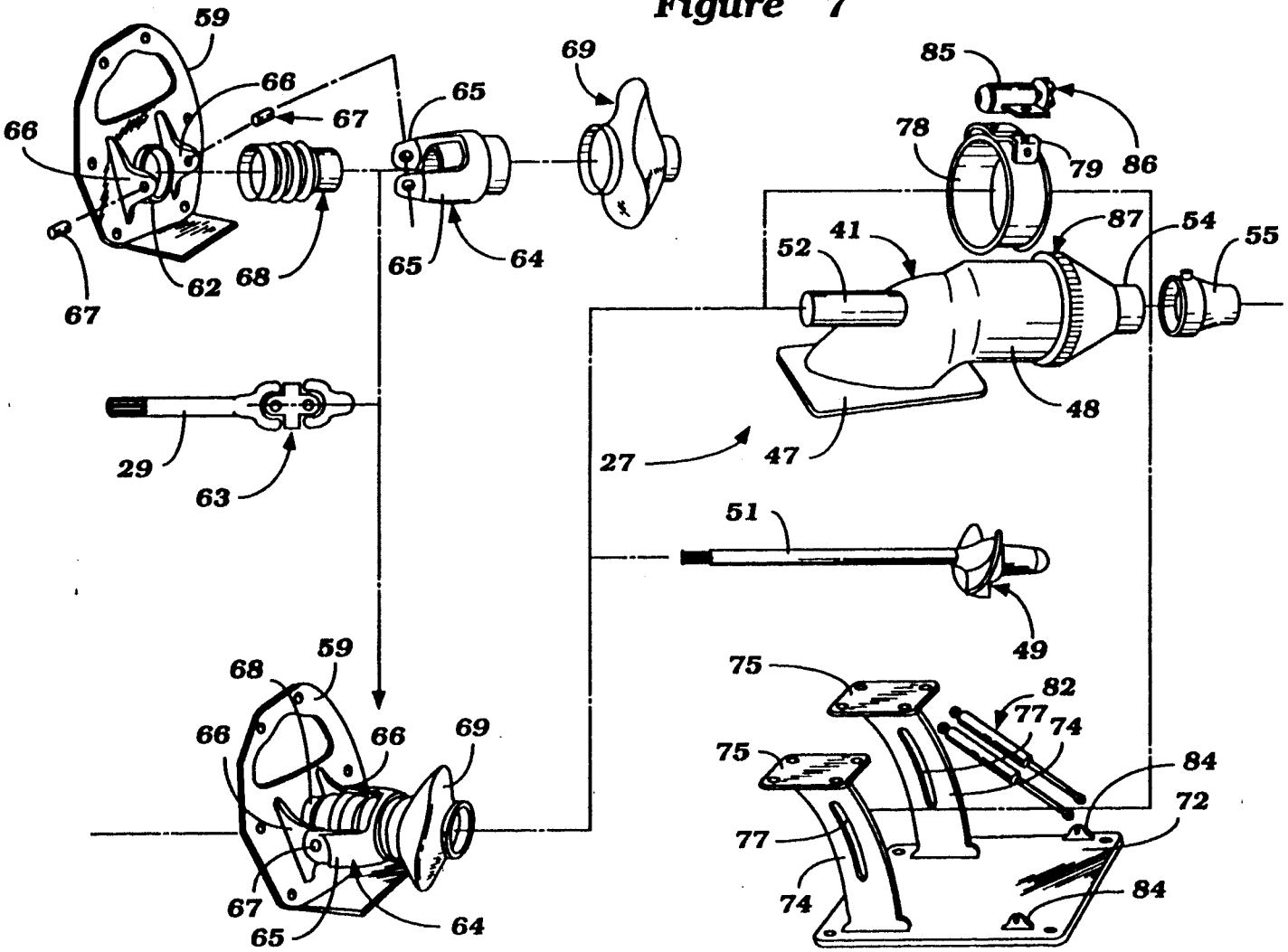
FIG. 7 is an enlarged exploded perspective view of one of the jet propulsion units.

Each jet propulsion unit 27 is positioned to the rear of a vertically extending wall 28 that defines the forward end of the tunnel 24. A single internal combustion engine or a pair of internal combustion engines are supported forwardly of the wall 28 in an appropriate manner and drive drive shafts 29 (FIG. 6) that extend through openings in the walls 28. Referring now primarily to FIGS. 6 and 7, it will be noted that each jet propulsion unit 27 is comprised primarily of an outer housing 41 which may be of a unitary or fabricated construction. The outer housing 41 defines a water inlet portion 45 that terminates in a downwardly extending water inlet opening 46 that is defined by a peripheral flange 47. In the normal operating condition, the opening 46 and a portion of the inlet, 45 is disposed beneath the normal operating water level.

Rearwardly of the inlet portion 45, the housing 41 defines an impeller housing portion 48 in which an impeller 49 (FIG. 7) is supported for rotation in a suitable manner. The impeller 49 is affixed to an impeller shaft 51 which, in turn, extends forwardly through the water inlet portion 45 and through a cylindrical projection 52 of the housing 44. A pair of water seals 53 ar interposed between the impeller shaft 51 and the housing portion 52 so as to prevent leakage.

The impeller housing 48 terminates at its rearward end in a convergent section 54 to which a pivotally supported steering discharge nozzle 55 is journaled about a pair of vertically extending pivot pins 56. The steering nozzles 55 are steered from the steering wheel 16 by a suitable linkage system (not shown).

A support plate 59 is affixed to the rear side of the bulkhead 28 by threaded fasteners 61 and has a cylindrical flange 62 that is telescoped around the drive shaft 29.

At its rear end, the drive shaft 58 is connected by means of a universal joint, indicated generally by the reference numeral 63 to the impeller shaft 51. A yoke member 64 has a connection to the forward end of the impeller housing portion 52 and has a pair of bifurcated arms 65 that are pivoted to a pair of rearwardly extending arms 66 of the plate 59 by means of pivot pins 67. As a result of this connection, the entire jet propulsion units 27 may be pivoted about a transverse horizontally extending axis defined by the pivot pins 67 relative to the hull of the watercraft, for a reason which will be described. An elastic sealing boot 68 encircles the universal joint 63 and provides a watertight seal in this area.

A further flexible sealing boot 69 is provided around the jet propulsion unit portion 52 and the yoke 64 so as to provide good watertight construction while permitting relative rotation of the jet propulsion unit 27 about the axis of the impeller shaft 51 in a manner as will be described. The boots 68 and 69, therefore, act together so as to provide a good watertight seal and so as to permit the movements which will be described.

As should be readily apparent, the jet propulsion units 27 provide good power sources for the watercraft and nevertheless provides a very neat and clean appearance. When the watercraft 11 is in its normal operating mode, the water inlet portions 45 and inlet openings 46 of the jet propulsion units 27 will be submerged at least partially below the normal water level in which the watercraft is operating, which water level is shown in the drawings by the line 71. However, as a result of this submersion, foreign material and encrustation can occur on the jet propulsion unit such as barnacle formation. This is not at all desireable. Therefore, an arrangement is provided for pivoting the jet propulsion units 27 upwardly about the pivot axes described by the pivot pins 67 during periods of time when the watercraft is not in use. This mechanism is the same for each jet propulsion unit 27 and includes a plate 72 that is affixed to the rear of the hull 12 beneath the respective portion of the tunnel 24 and rearwardly of the water inlet opening 46 of the jet propulsion unit 27.

It should be noted that a seal arrangement 73 is carried by the peripheral flange 47 of the jet propulsion unit housing around the inlet opening 46 for sealing with the hull, the plate 72 and a horizontally extending flange when the unit is in its normal drive position, as shown in the solid line view of FIG. 6. This is important for insuring good efficiency of the jet propulsion unit 27.

The plate 72 has a pair of upwardly extending arcuate arms 74 that have flanges 75 at their upper end which are secured to the underside of the surface 26 of the hull which defines the tunnel 24. The arms 74 have arcuately shaped slots 77 which extend along a radius defined by the pivot points defined by the pins 67 that pivotally journal the jet propulsion unit 27. A support ring 78 encircles the jet propulsion unit and specifically the impeller housing portion 48 and journals it for rotation about an axis that is coincident with the rotational axis of the impeller shaft 51. The support ring 78 has a bracket portion 79 affixed to its upper end and which receives a pair of pins 81 for slidably supporting the support ring 78 in the slots 77 of the arms 74. In addition, a pair of hydraulic cylinders 82 are pivotally connected at one end to the pins 81 and at their opposite ends, by means of further pins 83 to a pair of lugs 84 formed on the plate 72.

Figure 3:
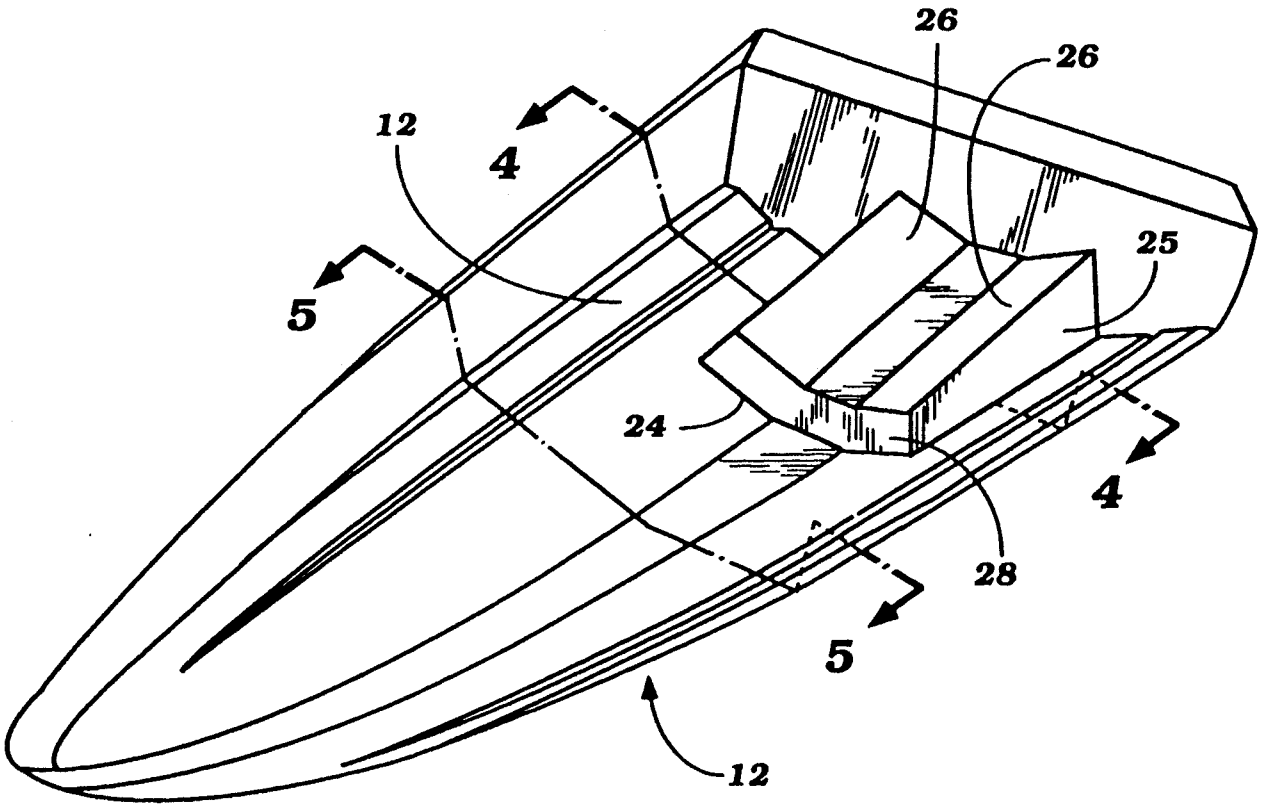
FIG. 3 is a top front perspective view of the lower hull portion with a part removed to more clearly show the configuration of the lower part thereof.

When the cylinders 82 are extended or retracted, the respective jet propulsion unit 27 will be pivoted about the first axis defined by the pins 67 which are aligned with the universal joint 63 between its lower normal position as shown in the solid line view of FIG. 3 to a raised or out of the water storage, service position as shown in the phantom line view of this figure. When so raised, the unit opening 46 will be disposed above the water level 71 and hence the jet propulsion unit 27 will be raised out of the water and the problems as aforenoted will not occur. In addition, all water will drain out of the jet propulsion unit 27 and this will provide assurance against any problems.

In order to provide further assurance against water damage when the watercraft is not being operated and also so as to afford access for servicing, each jet propulsion unit 27 may be rotated about the aforedescribed pivotal axis defined by the support ring 78. To this end, an electric or hydraulic motor 85 is supported on the support ring 78 and has a driven gear 86 that is enmeshed with a ring gear 87 formed on the jet propulsion unit 31. When the motor 85 is operated, the entire jet propulsion unit 27 will rotate about the axis of the impeller shaft 51 while the boot 69 torsionally deflects so that the unit 27 may be positioned so that the water inlet portion 45 and inlet opening 46 instead of facing downwardly face upwardly. This will place the inlet opening 45 in such a direction that water cannot inadvertently enter the jet propulsion unit when it has been elevated.

This rotation also gives rise to the ability to service the jet propulsion units 27 by removing foreign particles from the impeller housing through the opening 46. To accomplish this, there are provided access openings 89 in the hull portion 26 that have access doors 91 (FIGS. 4 and 6) for servicing. The access doors 91 have a construction as best shown in FIG. 6 and the associated opening 89 has a hinge 93 for pivotally supporting a closure plate 94 for movement between a closed position as shown and an open or service position as shown in phantom in FIG. 6. A turnbuckle type fastener 95 cooperates with the hull for holding the closure plate 94 in its closed position.

An operator may conveniently open either of the access doors 91 and obtain access to the respective jet propulsion unit 27 when it has been pivoted about the pivot axis defined by the pivot pins 67 through actuation of the cylinder assemblies 82 by a suitable control and when the motor 85 has been rotated so as to swing the jet propulsion unit 27 to its service position as shown in phantom in FIG. 6. The operator may easily reach into the inlet opening 46 and clear any entrapped material from the impeller housing. In addition to permitting the jet propulsion units 27 to be swung up for servicing as aforedescribed and for protection when not in use, the hydraulic motors 82 may be operated so as to provide trim adjustment for the units 27.

The arms 74 in addition to providing a path of movement for the jet propulsion units 27 as they pivot about the axis defined by the pivot pins 67, also serve to take side thrusts from the jet propulsion unit during its operation. Thus, the assembly is quite rigid even though the jet propulsion units 27 may pivot both about a horizontally extending transverse axis and a longitudinally extending horizontal axis. It should be noted that it is desirable to effect pivotal movement about the transverse pivot axis before rotation of the jet propulsion unit 27 about the longitudinal axis is accomplished in order to minimize wear on the seal 73. In the illustrated embodiment, the seal 73 is being described as being carried by the flange 47 of the jet propulsion unit 27. It is to be understood, of course, that the seal ca be fixed to the hull of the watercraft rather than the jet propulsion unit. In addition, various other types of seal arrangements can be employed without deviating from the invention.

It should be readily apparent the that use of the dual jet propulsion units 2 provides strong propulsion for the watercraft 11 and a neat overall watercraft appearance. In addition, since each of the jet propulsion units 27 is both rotatable and pivotal, the jet propulsion units can be easily serviced and also can be tilted and rotated up out of the water when the watercraft is not being operated so as to avoid encrustation. Although in the described embodiment the jet propulsion units are both pivotal and rotatable, in some instances it may be possible merely to have the units pivotal or only rotatable only so as to achieve the aforenoted results.

Figure 4:
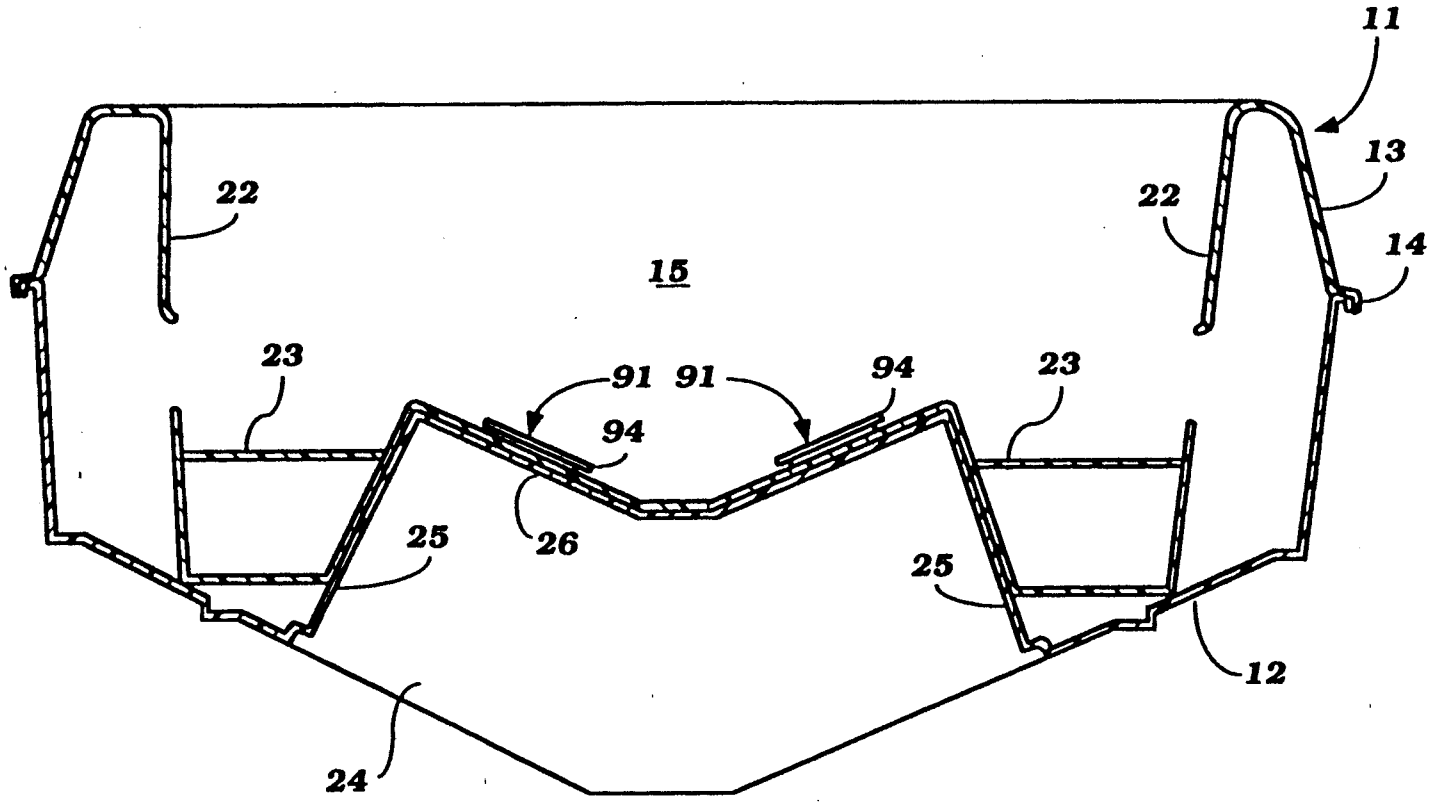
FIG. 4 is an enlarged cross sectional view taken generally along the line 4—4 but showing the full hull.
Figure 5:
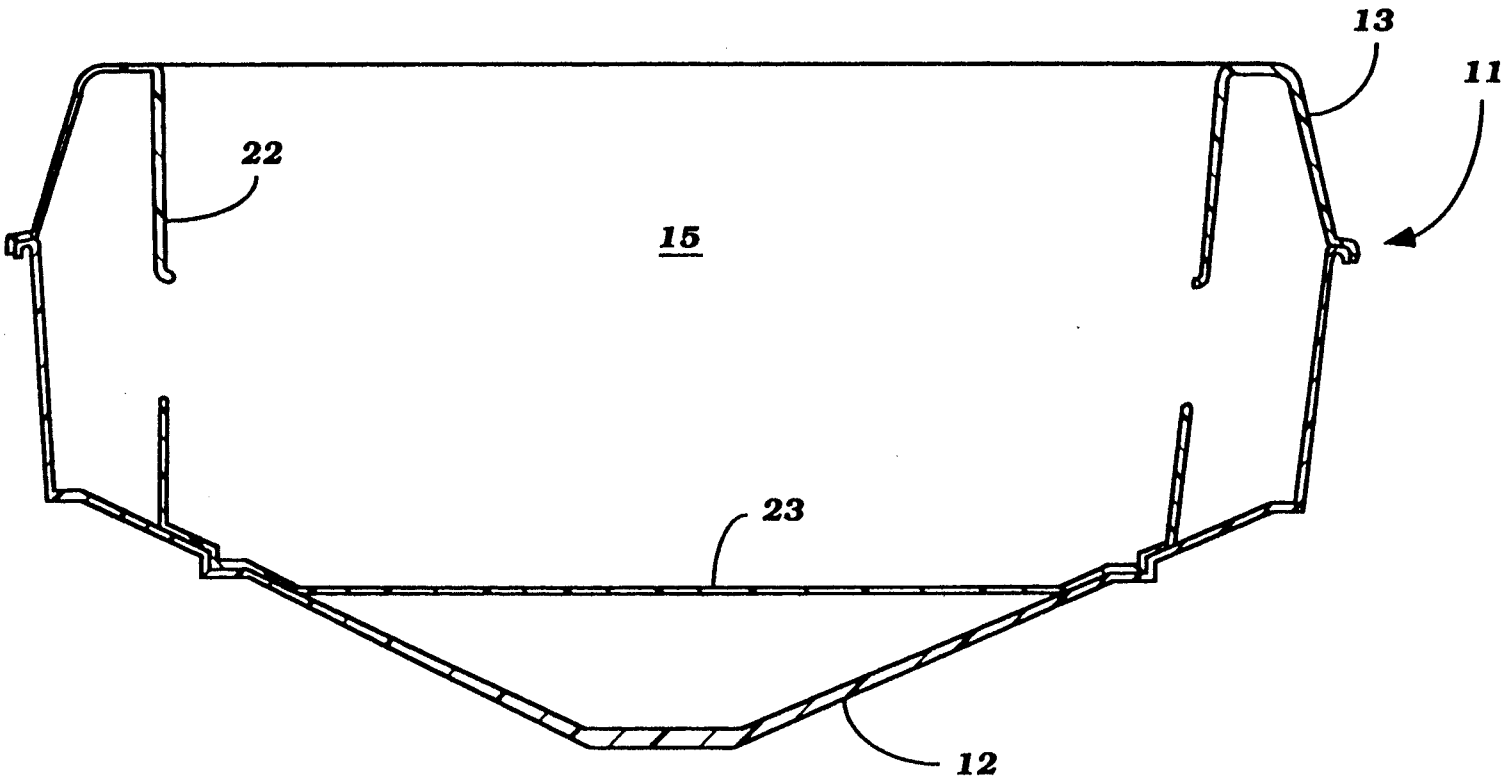
FIG. 5 is an enlarged cross sectional view taken along the line 5—5 in FIG. 3, again showing the full hull.
Figure 8:
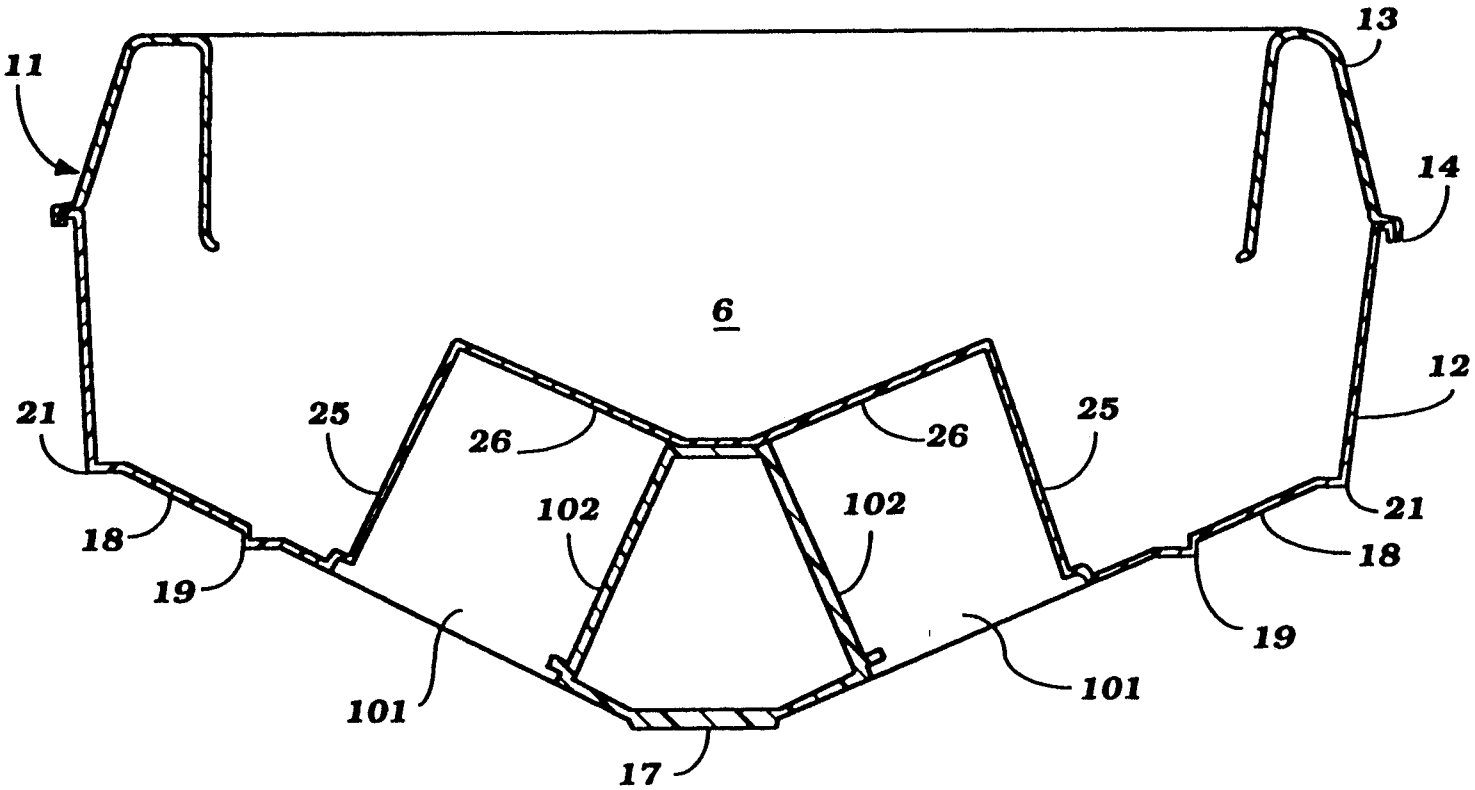
FIG. 8 is a cross sectional view taken along a plane corresponding to the plane of FIG. 4 and showing another embodiment of the invention.

In the embodiment of FIGS. 1 through 7 a single tunnel 24 was provided in the lower hull portion 12 for housing both of the jet propulsion units 27. In some instances, it may be desirable to provide separate tunnel portions so that the area between them will be filled. FIG. 8 shows such an embodiment. Since this embodiment is generally the same as the previously described embodiment, only a cross sectional view corresponding to the view of FIG. 4 is believed necessary to permit those skilled in the art to understand the construction and operation of this embodiment. Also, since the jet propulsion units for this watercraft may be identical to those of the previously described embodiments or the variations mentioned therein, they have not been illustrated. Also, components of the watercraft which are the same or substantially the same as the previously described embodiment have been identified by the same reference numerals.

Referring now specifically to FIG. 8, it should be noted that the interior configuration of the watercraft in the area where the tunnel is formed is the same as the previously described embodiment. That is, the passenger compartment has extending into it a raised portion formed by the inclined surfaces 26 and side walls 25. However, these constructions provide a pair of separate tunnel portions 101 that are separated by a generally pie shaped segment formed by the lower flat portion 17 of the hull and a pair of upstanding walls 102 that extend from the adjacent sides of the inclined portions 18 u to the upper wall 26. Hence, the open center of the tunnel of the previously described embodiment is avoided with this construction. In all other regards, this embodiment is the same. Further description of it is not believed to be necessary.

It should be readily apparent from the foregoing description that the embodiments of the invention are particularly useful in providing a watercraft hull that has a neat and smooth appearance and yet one which can transmit high driving thrusts through the use of the two jet propulsion units. In addition, the moveable support for the jet propulsion units permits their servicing as well as their being brought up out of the water when the watercraft is not in use to avoid encrustation. Although several embodiments of the invention have been illustrated and described, various changes and modifications may be made without departing from the spirit and scope of the invention, as defined by the appended claims.

I claim:

1. A watercraft having a hull with a transom, tunnel means at the rear of said hull and a V-bottom and a pair of separate jet propulsion units each mounted in said tunnel means in generally parallel relationship to each other each on a respective side of said V-bottom, each of said jet propulsion units having its own normally downwardly facing inlet for receiving water on a respective side of said V-bottom from a body of water in which said watercraft in operating, an impeller section and a discharge nozzle for discharging water rearwardly through said transom on a respective side of said V-bottom for propelling said hull.

2. A watercraft as set forth in claim 1 wherein the tunnel means comprises a common tunnel in which each of the jet propulsion units are positioned.

3. A watercraft as set forth in claim 1 wherein the tunnel means comprises a pair of tunnels each receiving a respective one of the jet propulsion units.

4. A watercraft as set forth in claim 3 wherein the tunnels are separated by a common bulkhead.

5. A watercraft having a hull with a transom and a pair of separate jet propulsion units each mounted in said hull in generally parallel relationship to each other, each of said jet propulsion units having its own normally downwardly facing inlet for receiving water from a body of water in which said watercraft is operating, an impeller section and a discharge nozzle for discharging water rearwardly through said transom for propelling said hull, said jet propulsion units being mounted in tunnel means formed at the rear of said hull.

6. A watercraft as set forth in claim 5 wherein the tunnel means comprises a pair of tunnels each receiving a respective one of the jet propulsion units.

7. A watercraft as set forth in claim 5 wherein the tunnel means comprises a common tunnel in which each of the jet propulsion units are positioned.

8. A watercraft having a hull and a pair of jet propulsion units each mounted in tunnel means formed at the rear of said hull in generally parallel relationship to each other, each of said jet propulsion units having an inlet for receiving water from a body of water in which said watercraft is operating, an impeller section and a discharge nozzle for discharging water propelling said hull, said tunnel means comprising a common tunnel in which each of said jet propulsion units are positioned.

9. A watercraft having a hull and a pair of jet propulsion units each mounted in tunnel means formed at the rear of said hull in generally parallel relationship to each other, each of said jet propulsion units having an inlet for receiving water from a body of water in which said watercraft is operating, an impeller section and a discharge nozzle for discharging water for propelling said hull, said tunnel means comprising a pair of tunnels each receiving a respective one of the jet propulsion units, said tunnels being separated by a common bulkhead.

10. A watercraft having a hull with a V configuration and a pair of jet propulsion units each mounted in said hull in generally parallel relationship to each other, each on a respective side of said V configuration, each of said jet propulsion units having an inlet for receiving water from a body of water in which said watercraft is operating, an impeller section and a discharge nozzle for discharging water for propelling said hull, said propulsion units being mounted in tunnel means formed at the rear of said hull.

11. A watercraft as set forth in claim 10 wherein the tunnel means comprises a common tunnel in which each of the jet propulsion units are positioned.

12. A watercraft as set forth in claim 19 wherein the tunnel means comprises a pair of tunnels each receiving a respective one of the jet propulsion units.

13. A watercraft as set forth in claim 12 wherein the tunnels are separated by a common bulkhead.

14. A watercraft having a hull and a pair of jet propulsion units each mounted in said hull in generally parallel relationship to each other, each of said jet propulsion units having an inlet for receiving water from a body of water in which said watercraft is operating, an impeller section and a discharge nozzle for discharging water for propelling said hull, said jet propulsion units being supported for rotation relative to said hull about an axis aligned with their impeller axes for changing their orientation relative to said hull.

15. A watercraft as set forth in claim 14 wherein the jet propulsion units are pivotal relative to the hull about an axis extending transversely to the axis of the impeller section.

16. A watercraft as set forth in claim 14 wherein the jet propulsion units are also rotatable about their impeller section axis relative to the hull.

17. A watercraft having a hull and a pair of jet propulsion units each mounted in said hull in generally parallel relationship to each other in tunnel means formed at the rear of said hull, each of said jet propulsion units having an inlet for receiving water from a body of water in which said watercraft is operating, an impeller section and discharge nozzle for discharging water for propelling rearwardly through said transom on a respective side of said V-bottom for propelling said hull.

18. A watercraft as set forth in claim 17 wherein the tunnel means comprises a pair of tunnels each receiving a respective one of the jet propulsion units.

19. A watercraft as set forth in claim 17 wherein the tunnel means comprises a pair of tunnels each receiving a respective one of the jet propulsion units.

20. A watercraft as set forth in claim 19 wherein the tunnels are separated by a common bulkhead.

21. A watercraft as set forth in claim 17 further including an access opening formed in the hull through which the inlet of the jet propulsion unit is accessible when the orientation of the jet propulsion unit is changed from a normal running orientation.

22. A watercraft as set forth in claim 17 wherein movement of the jet propulsion unit from a normal position relative to the hull to another position brings the inlet of the jet propulsion unit out of the body of water in which the watercraft is.

23. A watercraft having a hull with a transom and a pair of separate jet propulsion units each mounted in said hull in generally parallel relationship to each other, each of said jet propulsion units having its own normally downwardly facing inlet for receiving water from a body of water in which said watercraft is operating, an impeller section and a discharge nozzle for discharging water rearwardly through said transom for propelling said hull, said jet propulsion units each having at least its inlet supported for rotation relative to the hull about axes extending longitudinally of said hull.

24. A watercraft as set forth in claim 23 wherein the jet propulsion units are also pivotal relative to the hull about an axis extending transversely to the axis of the impeller section.

25. A watercraft as set forth in claim 23 wherein the jet propulsion unit are rotatable about their impeller section axes relative to the hull.

26. A watercraft having a hull with a transom and a pair of separate jet propulsion units each mounted in tunnel means formed at the rear of the hull in generally parallel relationship to each other, each of said jet propulsion units having its own normally downwardly facing inlet for receiving water from a body of water in which said watercraft is operating, an impeller section and a discharge nozzle for discharging water through said transom for propelling said hull, said jet propulsion units being supported for movement relative to said hull for changing their orientation relative to said hull.

27. A watercraft as set forth in claim 26 wherein the tunnel means comprises a common tunnel in which each of the jet propulsion units are positioned.

28. A watercraft as set forth in claim 26 wherein the tunnel means comprises a pair of tunnels each receiving a respective one of the jet propulsion units.

29. A watercraft as set forth in claim 28 wherein the tunnels are separated by a common bulkhead.

30. A watercraft as set forth in claim 26 further including an access opening formed in the hull through which the inlet of the jet propulsion unit is accessible when the orientation of the jet propulsion unit is changed from a normal running orientation.

31. A watercraft as set forth in claim 26 wherein movement of the jet propulsion unit from a normal position relative to the hull of another position brings the inlet of the jet propulsion unit out of the body of water in which the watercraft is operating.

* * * * *

UNITED STATES PATENT AND TRADEMARK OFFICE

CERTIFICATE OF CORRECTION

PATENT NO. : 5,203,728

DATED : April 20, 1993

INVENTOR(S) : Noboru Kobayashi

It is certified that error appears in the above-indentified patent and that said Letters Patent is hereby corrected as shown below:

On the title page, Item [56]: U.S. Patent, reference 3,207,116, "FRX" should be —France—.

Column 6, line 22, Claim 1, "in" should be --is--.

Column 7, line 14, Claim 12, "19" should be --10--.

Column 7, lines 43-44, Claim 17, "rearwardly through said transom on a respective side of said V-bottom for propelling" should be --said hull, said jet propulsion units being supported for movement relative to said hull for changing their orientation relative to--.

Column 7, lines 47-48, Claim 18, "a pair of tunnels each receiving a respective one of the jet propulsion units" should be --a common tunnel in which each of the jet propulsion units are positioned--.

Column 8, line 24, Claim 25, after "unit" insert --inlets--.

Signed and Sealed this

Thirty-first Day of May, 1994

*Attest:*

*Attesting Officer*

BRUCE LEHMAN

*Commissioner of Patents and Trademarks*